US006101852A

United States Patent [19]

Steinbach

[11] Patent Number: 6,101,852

[45] Date of Patent: Aug. 15, 2000

[54] PADLOCK WITH REMOVABLE SHACKLE

[75] Inventor: Robert L. Steinbach, Kenosha, Wis.

[73] Assignee: CompX International Inc., Mauldin, S.C.

[21] Appl. No.: 09/262,899

[22] Filed: Mar. 5, 1999

[51] Int. Cl.[7] ..... E05B 67/24

[52] U.S. Cl. ..... 70/38 A; 70/39; 70/51

[58] Field of Search ..... 70/38 A, 39, 51, 70/52

[56] References Cited

U.S. PATENT DOCUMENTS

| | | | |
|---|---|---|---|
| 1,718,606 | 6/1929 | Soref | 70/52 |
| 2,094,604 | 10/1937 | Keil | 70/52 |
| 2,352,190 | 6/1944 | Foote et al. | 70/52 |
| 3,835,675 | 9/1974 | Lippisch | 70/52 X |
| 4,112,716 | 9/1978 | Wippich | 70/52 X |
| 4,241,594 | 12/1980 | Miller et al. | 70/38 A |
| 4,464,915 | 8/1984 | Moshe et al. | 70/52 |
| 4,545,223 | 10/1985 | Poutiainen et al. | 70/38 A |
| 4,551,997 | 11/1985 | Huang | 70/52 X |
| 4,881,387 | 11/1989 | Kortenbrede | 70/39 |
| 5,417,092 | 5/1995 | Iu | 70/39 X |
| 5,572,890 | 11/1996 | Carpenter | 70/52 X |
| 5,640,861 | 6/1997 | Chen | 70/39 X |

FOREIGN PATENT DOCUMENTS

| | | | |
|---|---|---|---|
| 97097 | 5/1924 | Austria | 70/38 A |
| 476229 | 3/1992 | European Pat. Off. | 70/39 |
| 3228613 | 2/1984 | Germany | 70/38 A |

*Primary Examiner*—Lloyd A. Gall
*Attorney, Agent, or Firm*—Banner & Witcoff

[57] ABSTRACT

An improved padlock assembly is provided which includes a lock body, a shackle with a pair of opposed legs fitting into the lock body, and the lock body including an interior chamber in which are positioned a pair of reciprocal lock plates. A first lock plate operates in response to the manipulation of the lock cylinder, while the second lock plate operates in response to a lock pin to keep it in a locked and/or unlocked position. The entire shackle may be removed by first removing the first shackle leg from locking engagement with the first lock plate, moving the first lock plate back to its locked position, afterwhich the lock pin may then be removed to move the second lock plate to its unlocked position in order to free the second leg of the shackle and thereby remove the entire shackle.

9 Claims, 1 Drawing Sheet

FIG.1
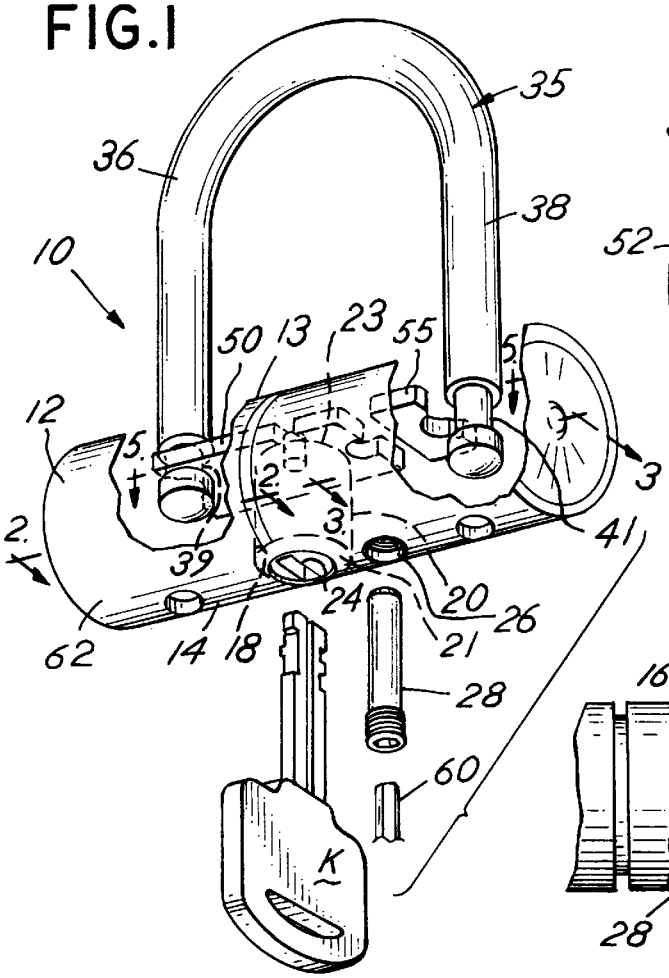
FIG. 2
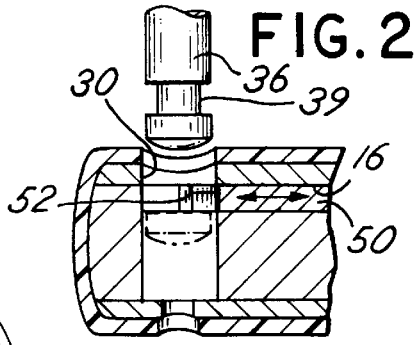
FIG. 3
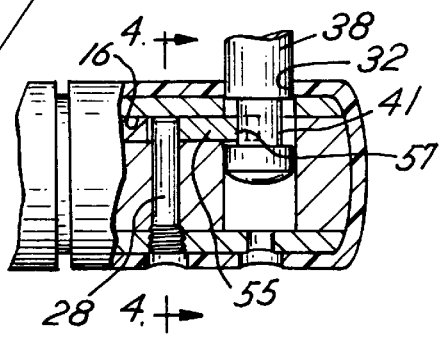
FIG.5
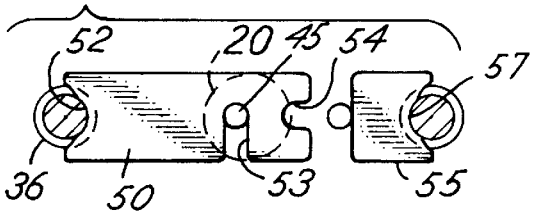
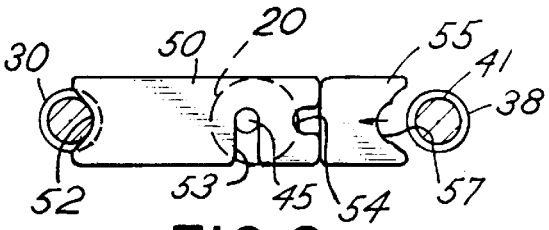
FIG.6
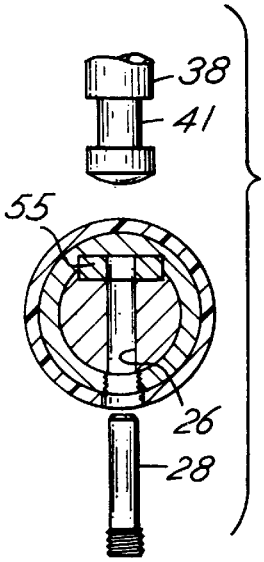
FIG.4

PADLOCK WITH REMOVABLE SHACKLE

BACKGROUND OF THE INVENTION

The present invention is intended as an improvement on padlock assemblies. More specifically, the present invention intends to provide a padlock wherein the shackle is removable such that alternate shackles may be employed on the same lock body.

A wide variety of padlock assemblies have been developed in the art field. Indeed, various padlocks have been developed which may either be key operated, and within that category, operated by single-bitted flat keys, or tubular keys. Other padlocks are operated by means of a combination code which basically employ coded combinations of usually three numeric designations in order to unlatch the lock. In most applications, the purpose of the padlock is to engage one of the shackle legs into a locked position when the padlock is in its locked mode, and permit the user to operate the lock into an unlocked position to release the single shackle thereby opening the lock for the user to gain access to the lock compartment.

The present invention has its specific improvement the ability to remove the entire shackle from the lock body in order to permit the user to use alternate shackles, especially those perhaps of an increased length or height such that the same lock may be employed for different uses. For example, an enlarged shackle is used in such applications as bicycle locks or other applications where an enlarged shackle must be employed, and in reverse, some applications require a shackle with a very short height. In the past, it has been necessary to purchase different locks employing different shackle heights in order to accommodate different applications. The present invention is intended to provide a single lock body which may be provided with a series of varying shackle lengths such that the same lock may be employed for different applications by simply removing one shackle from the lock body, and employing the shackle of a height required for the purpose intended.

While the prior art has heretofore developed padlocks with removable shackles, it is believed that the present padlock assembly constitutes an improvement in terms of the operational characteristics of such types of padlocks. For example, U.S. Pat. No. 4,823,566 shows a padlock having a removable shackle. However, the subject padlock requires a specialized lock which is screw-threadedly mounted into the lock body, in order to manipulate the lock bolt body contained therein. Further, the lock mechanism is operated by a special tubular key which has a unique design in order to operate the unique lock. Therefore, the subject padlock cannot accommodate a typical single-bitted type key and lock combination or a tubular lock and key combination.

The same comments are applicable with respect to U.S. Pat. No. 4,823,567, which is a patent related to the U.S. Pat. No. 4,823,566 patent in that it is a Divisional patent to an alternate embodiment. Once again, the lock and key combination which must be employed in order to construct and operate the subject padlock assembly is a specialized unit, and therefore requires the user thereof to stock only the subject padlock and further requires the use of a specialized lock and key.

Another variation of a padlock having a removable shackle is shown in U.S. Pat. No. 4,112,715. In this particular construction, the lock mechanism employs a single lock plate having a pair of opposed arms which are operated by the lock cylinder and key combination. It will be appreciated that the operator may possibly place the lock plate into a position such that both shackles are removable when that is not the desired intention. This results from the fact that the entire lock plate is operable in response to the movement of the lock cylinder, which operates in response to the key. It will be appreciated from the following specification that the present invention provides a padlock assembly wherein the one shackle leg is removable by the operation of the lock mechanism, while the second shackle leg is only removable upon the manipulation of a second locking means to insure that the lock plates stay in place so that the assembly will operate as a padlock when so intended, while still permitting the shackle to be totally removable from the lock body.

OBJECTS AND ADVANTAGES

The object of the present invention is to provide an improved padlock assembly incorporating a removable shackle such that the shackle may be entirely removed from the lock body in order to permit alternate shackles to be employed on the same lock body.

In conjunction with the foregoing object, a further object of the present invention is to provide a padlock assembly including a removable shackle, wherein one leg of the shackle is in cooperative relation with the lock mechanism employed in the lock body, while the other shackle leg will remain in locked engagement with the lock body until a locking means is removed in order to permit the removal of the second shackle leg from the lock body thereby removing the entire shackle from the lock body.

In conjunction with the foregoing object, it is a further object of the present invention to provide a padlock assembly of the type described wherein one of the shackle legs may be alternately locked and unlocked relative to the locked body by the lock mechanism while the other shackle leg is retained in its locked position, while at the same time permitting the one shackle leg to be unlocked from the lock body, and after being positioned in the unlocked position, the operator may manipulate a locking means to unlock the second shackle leg from the locked body thereby to permit removal of the entire shackle from the lock body.

In furtherance of the above objects, a further object is to provide a padlock assembly wherein the padlock assembly includes a lock body having an interior chamber in which a first lock plate positioned in the interior chamber being reciprocably slideable relative to the shackle leg thereby to facilitate the locking and unlocking thereof, and a second lock plate positioned in the interior chamber which is held in a normal locking engagement with the second shackle leg, by means of a locking pin, whereby upon removal of the locking pin, the second shackle leg may similarly be removed from the lock body.

A further object of the present invention is to provide a padlock assembly of the type described above, wherein the entire shackle may be removed from the lock body with a minimal of moving parts in order to maximize the economy of manufacturing, and to further facilitate the ease of use by the user thereof.

Further objects and advantages of the present invention will best be understood by reference to the following description taken in conjunction with the accompanying drawings.

SUMMARY OF THE INVENTION

In summary, the present invention provides a padlock assembly which permits the removal of the entire shackle from the lock body of the padlock such that alternate shackles may be employed on the same lock body. In this manner, it is contemplated that a single lock may be employed by the user which will come with a variety of shackles of varying heights such that the user may then accommodate the padlock device to a particular application which may require shackles of varying heights. This advantage eliminates the need for purchasing a separate lock for each separate application.

Further, it is intended that the present invention provide a padlock assembly with a removable shackle which minimizes the number of moving parts and permits the user to operate the same quickly and conveniently with a minimal chance of the lock mechanism jamming incident to the attempt to remove the shackle from the lock body.

In summary, the above is accomplished by providing a lock body having an upper side, a lower side, and an interior chamber and a pair of shackle receiving bores traversing the lock body from the upper side and extending into the lock body at least into the interior chamber. The lower side of the lock body includes a lock cylinder aperture traversing the lock body and opening into the interior chamber into which a lock mechanism is installed. The interior chamber includes a first lock plate which is reciprocally carried within the interior chamber being slidable between an open position and a locked position relative to one of the shackle receiving bores and a second lock plate reciprocally carried within the chamber and similarly being slidable between an open position and a locked position relative to the shackle receiving bore. The lock cylinder mechanism installed in the lock cylinder aperture is adapted to manipulate the first lock plate between an open and a locked position, and locking means is provided in the lock body and associated with the second lock plate in order to normally maintain the second lock plate in a locked position to lockingly engage a shackle leg in the shackle receiving bore while still permitting the manipulation of the locking means in order to permit the slidable reciprocation of the second slide plate to an open position and hence permit the removal of the second shackle leg from the lock body.

BRIEF DESCRIPTION OF DRAWINGS

FIG. 1 is a perspective view, partly in cross-section, showing the construction of the padlock of the present invention;

FIG. 2 is a cross-sectional view taken along the Line 2—2 of FIG. 1, showing a first lock plate in an unlocked position relative to the lock body and the shackle leg;

FIG.3 is a cross-sectional view in elevation, taken along the Line 3—3 of FIG. 1, showing the second lock plate in its locked disposition relative to the second shackle leg as positioned in the shackle receiving bore lock body;

FIG. 4 is a side cross-sectional exploded view of the shackle leg relative to the lock body and the locking pin associated with the second lock plate in operative relation therewith; FIG. 5 is a top view, partly in cross-section, taken along the Line 5—5 of FIG. 1, showing the first and second lock plates in locking engagement with the respective shackle legs;

FIG. 6 is a top view, partly in cross-section, showing the first and second lock plates in open positions relative to each of the two shackle legs thereby permitting removal of the shackle from the lock body.

DETAILED DESCRIPTION OF DRAWINGS

As shown in FIGS. 1 through 3, the present invention consists of a padlock assembly 10 generally formed by a lock body 12 including an upper or shackle engaging side or part 13 and a lower or key entry side or part, said sides or parts 13, 14 forming a shell or lock body 12. Interiorly, there is provided an interior chamber 16 which is generally rectilinear in configuration. The lower side 14 of the lock body 12 is provided with a lock cylinder aperture in which is fitted a lock mechanism 20. The lock mechanism 20 has an outer end 21 and an inner end 23. The outer end 21 is provided with a keyway 24 access to which is had through the lock cylinder aperture 18 along the lower side 14 of the lock body 12. The lock mechanism 20 is operated by means of a key K in a manner commonly known in the art. The lower side 14 of the lock body 12 also includes a lock pin aperture 26 which accommodates a lock pin 28 therein. The functioning of the lock pin 28 will be described more particularly hereinafter.

The upper side 13 of the lock body 12 is shown to be provided with a pair of shackle leg receiving bores 30 and 32 respectively (see FIGS. 2 and 3). The basic padlock assembly 10 is completed by means of a shackle 35 which includes a pair of opposed shackle legs 36 and 38 respectively in a manner commonly known in the art. Each shackle leg 36 and 38 is provided with a locking detent 39 and 41 respectively. As is well-known in the art, each of the shackle legs 36 and 38 is intended to be received within a corresponding shackle leg receiving bore 30 and 32 respectively, all as is commonly known.

With respect to FIGS. 5 and 6 of the drawings, it will be observed that the lock mechanism 20 includes, at its inner end 23, a circular cam 43 which is rotatably mounted on the inner end of the lock mechanism 20. The circular cam carries a lock stud 45 which is mounted thereon in an off center disposition. It will be appreciated that the manipulation of the lock mechanism 20 by the key K will cause a concomitant rotational movement of the circular cam 43 and hence a circular movement of the lock stud 45.

The padlock assembly 10, as previously indicated, includes an interior chamber 16 which is basically rectilinear in configuration.

As is shown in FIGS. 2, 3, 5 and 6 of the drawings, the interior chamber 16 is provided with a first lock plate 50 which is carried within the interior chamber 16, and adapted to be reciprocably slidable therein. The lock plate 50 is provided with a curvilinear locking edge 52 which is adapted and sized to be in cooperative relationship with respect to the shackle detent 39 of shackle leg 36. It will be further observed that the first lock plate 50 is provided with a lock slot 53 which accommodates the insertion of the lock stud 45 therein when in its assembled position. It will be appreciated that the manipulation of the lock mechanism 20 causes a rotational movement of the circular cam 43, and therefore the circular movement of the offset lock stud 45 which will therefore cause the slidable movement of the lock plate 50 relative to the shackle receiving bore and concomitant shackle detent 39 of shackle leg 38 when inserted in the bore 30. It will be appreciated that the manipulation of the lock 20 will therefore cause the locking and unlocking of the first lock plate 50 relative to the shackle leg 36 by engaging the curvilinear locking edge 52 of the first lock plate 50 into locking engagement in the shackle detent 39 of shackle leg 36.

It will also be observed that the interior chamber 16 is provided with a second lock plate 55 which also includes a locking edge 57 which is curvilinear in shape and is therefore designed to be in locking and unlocking engagement relative to the shackle detent 41 of shackle leg 38 when inserted in the shackle bore 32. As particularly shown in FIGS. 4 and 5 of the drawings, the lock pin 28, when inserted in the lock pin aperture 26 formed in the lock body 12 will rise up behind the second lock plate 55, and retain the second lock plate 55 in locking engagement relative to the shackle leg 38 by riding into the shackle detent 41. The first lock plate 50 will accommodate the positioning of the lock pin 28 by being appropriately slotted as indicated at 54 for a purpose to be described hereinbelow. It will therefore be appreciated that as illustrated in FIG. 3, when the lock pin 28 is installed through the lock pin aperture 26 into its locking engagement position, the second lock plate 55 is retained in locking engagement relative to the shackle leg 38 by riding into the shackle leg detent 41 thereof. When in this position, it will further be appreciated that the user may still manipulate the lock mechanism 20 in order to cause the rotational movement of the circular cam 43 and the concomitant movement of the lock stud 45 in order to slide the first lock plate 50 out of engagement with the shackle leg 36 by riding the locking edge 52 out of engagement from the shackle detent 39. In this position, the shackle leg 36 may be removed from the lock body 12 in order to open the padlock while still retaining the entire shackle 35 in a mounted position relative to the padlock 10.

In order to remove the shackle 35 from the lock body 12, one would simply open the padlock by manipulating the lock mechanism 20 such that the shackle leg 36 is removed from the lock body 12, after which the lock mechanism is then returned to its locked position, with the shackle leg 36 removed from the lock body 12, so that the first lock plate 50 is in the position as illustrated in FIG. 5. The user may then remove the lock pin 28 from the lock pin aperture 26, which will then free the second lock plate so that it can reciprocate into an open position relative to the shackle leg 38 and the corresponding shackle detent 41. In this position, the second shackle leg 38 may then be removed from the lock body 12 thereby totally removing the shackle 35 from the lock body 12. An alternate shackle may then be installed on the lock body 12, for example, a shackle having an enlarged height which may therefore be used for a different application. The shackle would then be reinstalled onto the lock body 12 by reversing the above procedure in that the second shackle leg is installed in the appropriate shackle receiving bore, and the second lock plate then slid into position afterwhich the lock pin is installed. This procedure may be accomplished by simply tipping the padlock on end in order to cause the second lock plate to slide down into locking engagement relative to the shackle detent of the shackle leg. The lock pin 28 may be retained in a locking position relative to the lock pin aperture by means of a threaded engagement as specifically illustrated in FIG. 4 of the drawings. In other words, a lock pin aperture 26 is provided with thread receiving ridges formed therein, and the lock pin 28 is provided with threads so that the lock pin may be screw-threaded into the lock pin aperture 26. A tool, such as an Allen wrench 60 may be utilized for screw-threading the lock pin 28 into the lock pin 26. It will be understood, however, that other locking means may be used for lockingly engaging the lock pin 28 into position in the lock pin aperture 26. However, within the spirit of the present invention, it is intended to simplify the manner in which the padlock assembly 10 of the present invention operates, and to minimize any parts which could possibly cause a lock jam of the padlock assembly 10.

As illustrated in FIGS. 5 and 6 of the drawings, the provision of the slotted accommodation in the first lock plate 50 permits the lock pin 28 to be positioned in lock position with respect to the second lock plate 55, while still accommodating the reciprocating sliding movement of the first lock plate 50 relative to the first shackle leg 36 in order to have the padlock assembly 10 operate as a padlock with only a single shackle leg being removed from the lock body 12 which lock body includes a plastic covering 62.

It will be appreciated from the above description that the present padlock assembly provides a padlock which includes a shackle which operates in a normal padlock manner, but is totally removable from the lock body thereof in order to accommodate the insertion of differently sized shackles such that the consumer may apply the lock to different applications. Further, the padlock assembly has been simplified in terms of the number of moving parts by eliminating any ratchet type assemblies or geared assemblies which could possibly cause the lock to malfunction by having an over-abundance of parts within the lock body. Finally, it will be appreciated that the shackle may be totally removed from the lock body without the need for extraneous tools or implements since an Allen wrench may be provided with the lock in order to accommodate the removal and re-insertion of the lock pin into the lock body in the manner as described.

It will also be appreciated that the padlock assembly of the present invention accommodates the use of any type of lock cylinder as desired by the manufacturer. Hence, a lock cylinder manipulated by a flat key, or a tubular key may similarly be utilized in connection with the present invention. Hence, during the manufacturing process, the lock cylinder aperture may be sized in order to accommodate presently available lock cylinders therein such that any type of lock cylinder operated with an appropriate key may be employed with the present assembly.

While there has been described what is at present considered to be the preferred embodiments of the invention, it will be appreciated that all obvious variations and modifications associated therewith may be employed and are intended to be covered by the claims of the present invention.

What is claimed is:

1. A shackle lock assembly comprising, a lock body having an upper side, a lower side and including an interior chamber and a first and second shackle receiving bore traversing said lock body from said upper side and extending into said lock body into at least said interior chamber, said lower side of said lock body having a lock cylinder aperture opening into said interior chamber, a first lock plate reciprocably carried within said interior chamber and being slideable between an open position and a lock position relative to the first shackle receiving bore, a second lock plate reciprocably carried within said interior chamber and being slideable between an open position and a lock position relative to the second shackle receiving bore, a lock cylinder mechanism carried within said lock cylinder aperture including operative means in cooperating relationship with said first lock plate in order to slidably manipulate said first lock plate between the open and lock positions respectively, locking means associated with said lower side of said lock body and being in cooperative relation with said second lock plate to maintain said second lock plate in a normal lock position and being operable to allow said second lock plate to slidably move to the open position, a shackle having first and second opposed, spaced shackle legs adapted to be received respectively within the confines of the first and second shackle receiving bores, said first and second shackle legs each including leg locking means adapted to be in cooperating relationship with said first and second lock plates respectively in order to allow said first and second shackle legs to be alternately positioned between an open and a lock position relative to said lock body, whereby said shackle may be lockingly engaged within said lock body and said first one of said shackle legs may be unlocked by slideable movement of the first plate to the open position while the second plate is in the lock position, said first plate being slideable to the lock position upon removal of the first shackle leg to permit operation of the locking means in cooperative relation with the second plate to allow the second plate to slidably move to the open position and thereby effect removal of the shackle from said lock body.

2. The shackle lock assembly as set forth in claim 1 above, wherein said lock cylinder includes an inner end and an outer end and a key way at said outer end allowing access thereto, and said operative means comprises a member on the inner end of said lock cylinder, said member including a lock stud mounted off-center thereon, and said lock stud adapted to be in operative relation to said first lock plate.

3. The shackle lock assembly as set forth in claim 2 above, wherein said first lock plate includes a slot formed therein, said slot adapted to receive said lock stud therein for reciprocating said first lock plate between an open and a lock position in response to the manipulation of said lock cylinder.

4. The shackle lock assembly as set forth in claim 1 above, wherein said lock body further includes a lock pin bore in said lock body, said bore opening into said interior chamber, and said locking means associated with said second lock plate comprises a lock pin removably carried in said lock pin bore such that said lock pin locks said second lock plate a lock position when fully inserted in the bore, and when withdrawn from said bore, is out of contact with said second lock plate thereby permitting said second lock plate to be slidably moveable to the open position.

5. The shackle lock assembly as set forth in claim 1 above, wherein said leg locking means comprises a circumferential detent adjacent the end of each leg, each of said detents adapted and sized to lockingly engage said first and second lock plates respectively.

6. The shackle lock assembly as set forth in claim 5 above, wherein said first lock plate includes an edge which is sized and adapted to reciprocate into locking and unlocking engagement relative to said detent of said first shackle leg thereby to lock and open said first shackle leg relative to said lock body.

7. The shackle lock assembly as set forth in claim 4 above, wherein said second lock plate includes a locking edge adapted to be in locking engagement with said lock pin when said lock pin is inserted in said lock pin bore and to be reciprocably movable to an open position when said lock pin is removed from said lock pin bore.

8. A shackle lock assembly comprising, a lock body having an upper side, a lower side and an interior chamber, a pair of shackle receiving bores traversing said lock body from said upper side and extending into said lock body interior chamber, said lower side of said lock body having a lock cylinder aperture traversing said lock body into said interior chamber, said lower side including a lock pin bore traversing said lock body into said interior chamber, a lock cylinder mechanism within said lock cylinder aperture, said lock cylinder mechanism having an inner end, an outer end and a keyway at said outer end allowing access thereto and a member on the inner end of said lock cylinder mechanism, said member including a lock stud mounted off center thereon, a first lock plate including a locking edge, said first plate reciprocably carried within said interior chamber of said lock body and being slideable between an open position and a locked position relative to one of said shackle receiving bores, said first lock plate having a slot formed therein, a second lock plate having a locking edge and carried within said interior chamber and being slidable between an open position and a locked position relative to the other shackle receiving bore, a lock pin removably carried within said lock pin bore, a shackle having a pair of opposed shackle legs, each of said shackle legs provided with a detent adjacent the end thereof, each of said detents sized to accept a locking edge of the corresponding first and second lock plates respectively, said first lock plate being movable between a locked position with said locking edge thereof in locking engagement with said detent of a corresponding shackle leg and movable to an open position by said stud of said lock mechanism with said locking edge being positioned out of engagement with said detent to permit removal of said shackle leg from said lock body, said second lock plate maintained in locked engagement by said lock pin being fully inserted within the lock pin bore and in locking engagement with the second lock plate, said lock pin being removable from said lock pin bore thereby to allow said second lock plate to reciprocate to an open unlocked position relative to said corresponding shackle leg and permit said shackle leg to be removed from said lock body thereby to permit the removal of the entire shackle from the lock body.

9. A shackle lock assembly comprising the combination:

a lock body member; and a removal shackle of the type having first and second spaced, opposing shackle legs, each leg including a detent at the end of each leg, said lock body member including an interior chamber, a first shackle bore into the chamber, a second shackle bore into the chamber, said first and second bores for receipt of the shackle end of the first and second shackle legs respectively, a lock cylinder mechanism carried by the lock body member and extending into the interior chamber, said lock mechanism including a key actuated cam in the interior chamber, a first lock plate slidably mounted in the interior chamber and movable between a closed position which will effect engagement with and an open position which will effect disengagement from the detent of the first shackle leg to thereby retain or release the first leg from the body member, said cam engagable with the first lock plate to move the plate between engagement with and disengagement from the detent of the first shackle leg in response to actuation of the lock cylinder mechanism;

a second lock plate slidable, independently from the first lock plate, said second lock plate moveable between engagement with and disengagement from the detent of the second shackle leg to thereby retain or release the second leg from the body member whenever the first lock plate is in a closed position;

a lock pin in the body member projecting into the interior chamber for engaging and retaining the second lock plate in a non-slidable position of engagement with the detent of the second shackle leg, said lock pin being removable from the body member to permit slidable movement of the second lock plate from the detent of the second shackle leg, whereby the second shackle leg is removable from the second shackle bore and release from the body member.

* * * * *